US006443076B1

(12) United States Patent
Case, Jr.

(10) Patent No.: US 6,443,076 B1
(45) Date of Patent: Sep. 3, 2002

(54) COLLAPSIBLE TABLE ASSEMBLY

(76) Inventor: Robert Lee Roy Case, Jr., P.O. Box 824, Brush, CO (US) 80723

( * ) Notice: Subject to any disclaimer, the term of this patent is extended or adjusted under 35 U.S.C. 154(b) by 0 days.

(21) Appl. No.: 09/732,579

(22) Filed: Dec. 8, 2000

(51) Int. Cl.[7] ..... A47B 13/02

(52) U.S. Cl. ..... 108/157.18; 297/158.5; 108/180

(58) Field of Search ..... 108/90, 135, 157.1, 108/157.16, 157.18, 158.12, 180, 155; 297/99, 157.1, 159.1, 158.5

(56) References Cited

U.S. PATENT DOCUMENTS

| | | | | | |
|---|---|---|---|---|---|
| 2,800,952 | A | | 7/1957 | Mc Philomy | |
| 3,300,245 | A | * | 1/1967 | Rumble | 108/158.12 X |
| 4,191,113 | A | * | 3/1980 | Hogberg | 108/157.16 X |
| D266,376 | S | * | 10/1982 | Musgrove | D6/45 |
| 4,607,880 | A | | 8/1986 | Gastebled | |
| 4,700,986 | A | | 10/1987 | Davis et al. | |
| 4,740,032 | A | | 4/1988 | Olsen et al. | |
| 4,834,450 | A | * | 5/1989 | Stickler | 108/180 X |
| D329,147 | S | | 9/1992 | Gandy | |
| 5,251,955 | A | | 10/1993 | Sarafa | |
| 5,367,964 | A | | 11/1994 | Hockensmith | |
| 5,752,450 | A | * | 5/1998 | Roesner | 297/157.1 X |
| 6,068,331 | A | * | 5/2000 | Barnes | 108/180 X |

* cited by examiner

*Primary Examiner*—Peter R. Brown
*Assistant Examiner*—Michael J. Fisher

(57) ABSTRACT

A collapsible table assembly for easier storage and transport of a portable table. The collapsible table assembly includes a pair of table end panels. Each of the table end panels comprises a top portion and a bottom portion. The collapsible table assembly also includes a plurality of table support sections. Each of the table support sections comprises at least a pair of cross-bars that have a pair of ends removably couplable to each of the end table sections. A table seat section comprises a panel that has a hole extending therethrough. In one embodiment, the hole has a size and shape designed for removably receiving the top portion of the end table panels therethrough. A tabletop section comprises a panel that includes a pair of ends and a pair of elongated slots extending therethrough for removably receiving a portion of the table end panels.

7 Claims, 4 Drawing Sheets

COLLAPSIBLE TABLE ASSEMBLY

BACKGROUND OF THE INVENTION

1. Field of the Invention

The present invention relates to tables and more particularly pertains to a new collapsible table assembly for easier storage and transport of a portable table.

2. Description of the Prior Art

The use of tables is known in the prior art. More specifically, tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,367,964; U.S. Pat. No. 5,251,955; U.S. Pat. No. 4,740,032; U.S. Pat. No. 4,700,9860; U.S. Pat. No. 4,607,880; U.S. Pat. No. 2,800, 952; and U.S. Pat. No. Des. 329,147.

While these devices fulfill their respective, particular objectives and requirements, the aforementioned patents do not disclose a new collapsible table assembly. The inventive device includes a pair of table end panels. Each of the table end panels comprises a top portion and a bottom portion. The collapsible table assembly also includes The collapsible table assembly also includes a plurality of table support sections. Each of the table support sections comprises at least a pair of cross-bars that have a pair of ends removably couplable to each of the end table sections. A table seat section comprises a panel that has a hole extending therethrough. In one embodiment, the hole has a size and shape designed for removably receiving the top portion of the end table panels therethrough. A tabletop section comprises a panel that includes a pair of ends and a pair of elongated slots extending therethrough for removably receiving a portion of the table end panels.

In these respects, the collapsible table assembly according to the present invention substantially departs from the conventional concepts and designs of the prior art, and in so doing provides an apparatus primarily developed for the purpose of easier storage and transport of a portable table.

SUMMARY OF THE INVENTION

In view of the foregoing disadvantages inherent in the known types of tables now present in the prior art, the present invention provides a new collapsible table assembly construction wherein the same can be utilized for easier storage and transport of a portable table.

The general purpose of the present invention, which will be described subsequently in greater detail, is to provide a new collapsible table assembly apparatus and method which has many of the advantages of the tables mentioned heretofore and many novel features that result in a new collapsible table assembly which is not anticipated, rendered obvious, suggested, or even implied by any of the prior art tables, either alone or in any combination thereof.

To attain this, the present invention generally comprises a pair of table end panels. Each of the table end panels comprises a top portion and a bottom portion. The collapsible table assembly also includes a plurality of table support sections. Each of the table support sections comprising at least a pair of cross-bars that have a pair of ends removably couplable to each of the end table sections. A table seat section comprising a panel that has a hole extending therethrough. In an embodiment the hole has a size and shape designed for removably receiving the top portion of the end table panels therethrough. A tabletop section comprising a panel includes a pair of ends and a pair of elongated slots extending therethrough for removably receiving a portion of the table end panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible table assembly apparatus and method which has many of the advantages of the tables mentioned heretofore and many novel features that result in a new collapsible table assembly which is not anticipated, rendered obvious, suggested, or even implied by any of the prior art tables, either alone or in any combination thereof.

It is another object of the present invention to provide a new collapsible table assembly which may be easily and efficiently manufactured and marketed.

It is a further object of the present invention to provide a new collapsible table assembly which is of a durable and reliable construction.

An even further object of the present invention is to provide a new collapsible table assembly which is susceptible of a low cost of manufacture with regard to both materials and labor, and which accordingly is then susceptible of low prices of sale to the consuming public, thereby making such collapsible table assembly economically available to the buying public.

Still yet another object of the present invention is to provide a new collapsible table assembly which provides in the apparatuses and methods of the prior art some of the advantages thereof, while simultaneously overcoming some of the disadvantages normally associated therewith.

Still another object of the present invention is to provide a new collapsible table assembly for easier storage and transport ofa portable table.

Yet another object of the present invention is to provide a new collapsible table assembly which includes a pair of table end panels. Each of the table end panels comprises a top portion and a bottom portion. The collapsible table assembly also includes a plurality of table support sections. Each of the table support sections comprising at least a pair of cross-bars that have a pair of ends removably couplable to each of the end table sections. A table seat section comprising a panel that has a hole extending therethrough. In an embodiment the hole has a size and shape designed for removably receiving the top portion of the end table panels therethrough. A tabletop section comprising a panel includes a pair of ends and a pair of elongated slots extending therethrough for removably receiving a portion of the table end panels.

Still yet another object of the present invention is to provide a new collapsible table assembly that is easily disassemble for easy storage and transportation.

Even still another object of the present invention is to provide a new collapsible table assembly that is entertaining for children and adults as a game requiring assembly of the table before it may be used.

Yet an even further object of the present invention is to provide a new collapsible table assembly that can be made from a single piece of 4 foot by 8 foot plywood.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
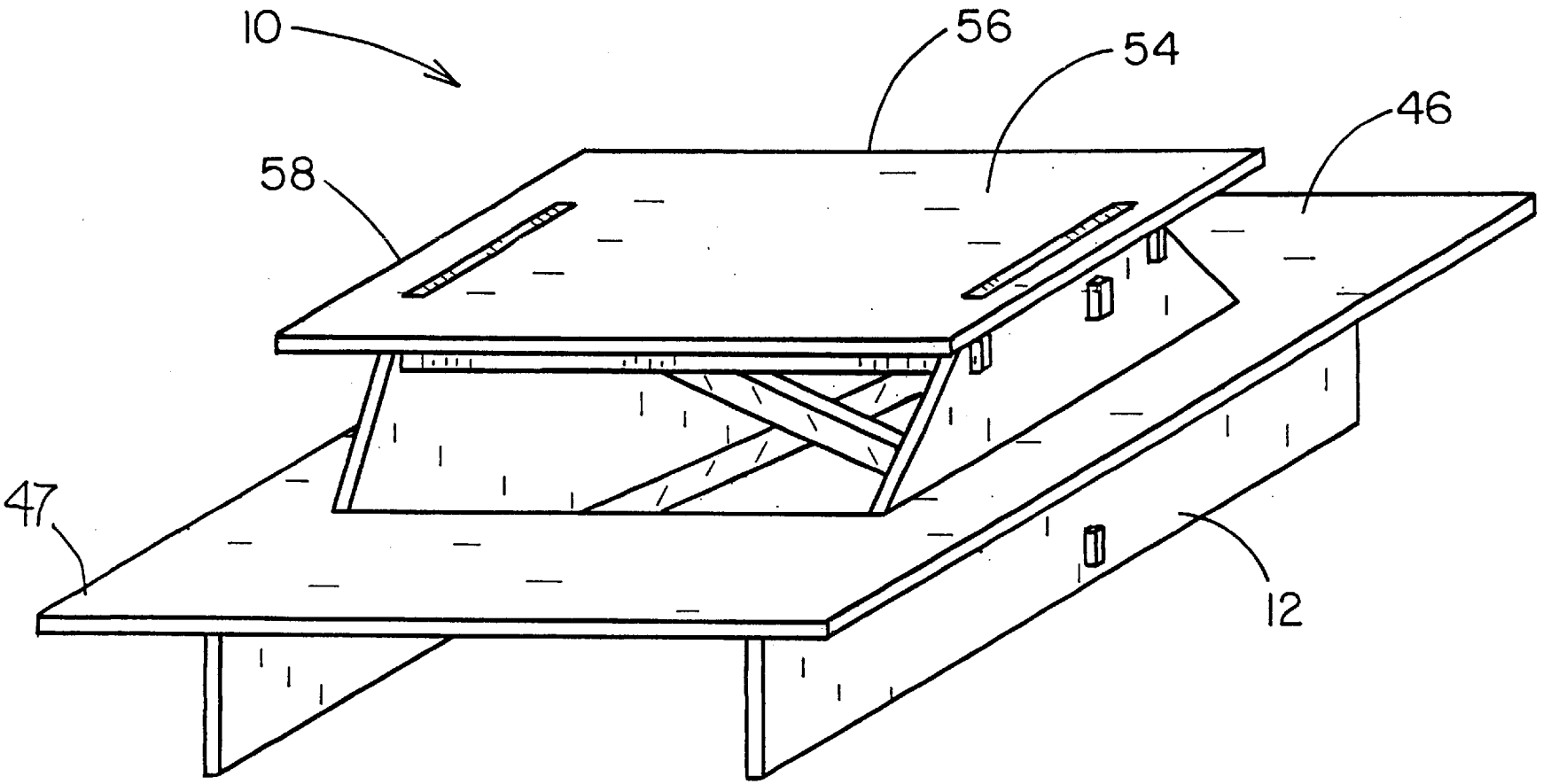
FIG. 1 is a schematic perspective view of a new collapsible table assembly according to the present invention showing the table in an assembled form.
Figure 2:
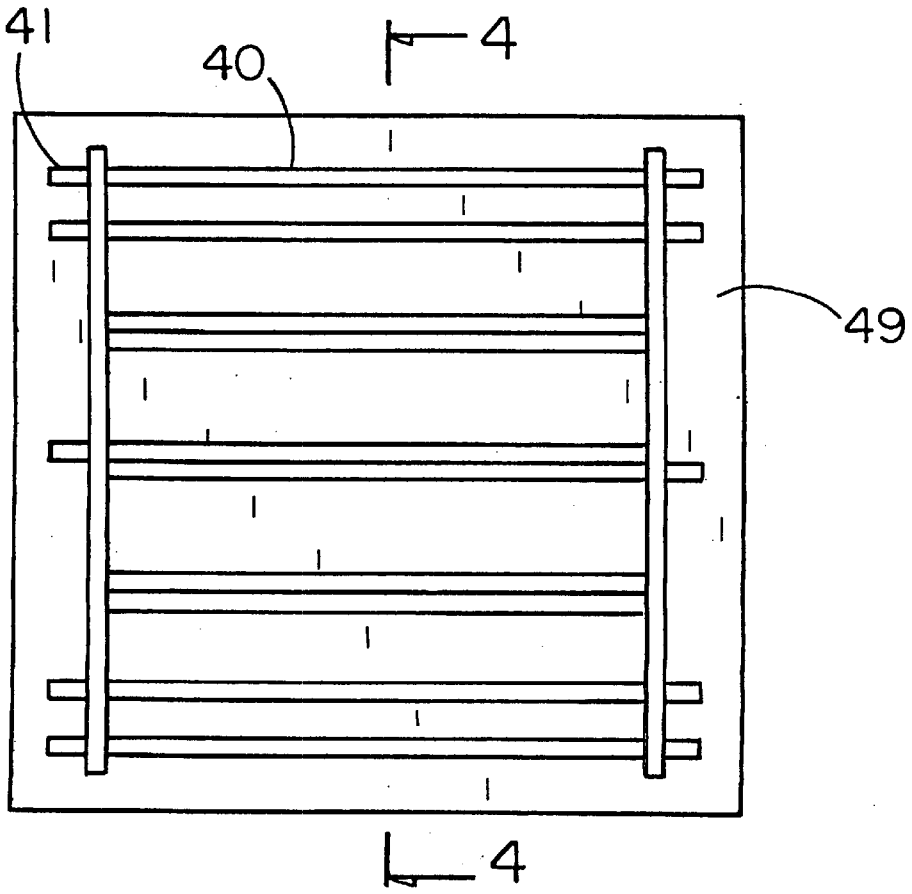
FIG. 2 is a schematic bottom view of the present invention showing a plurality of support sections.
Figure 3:
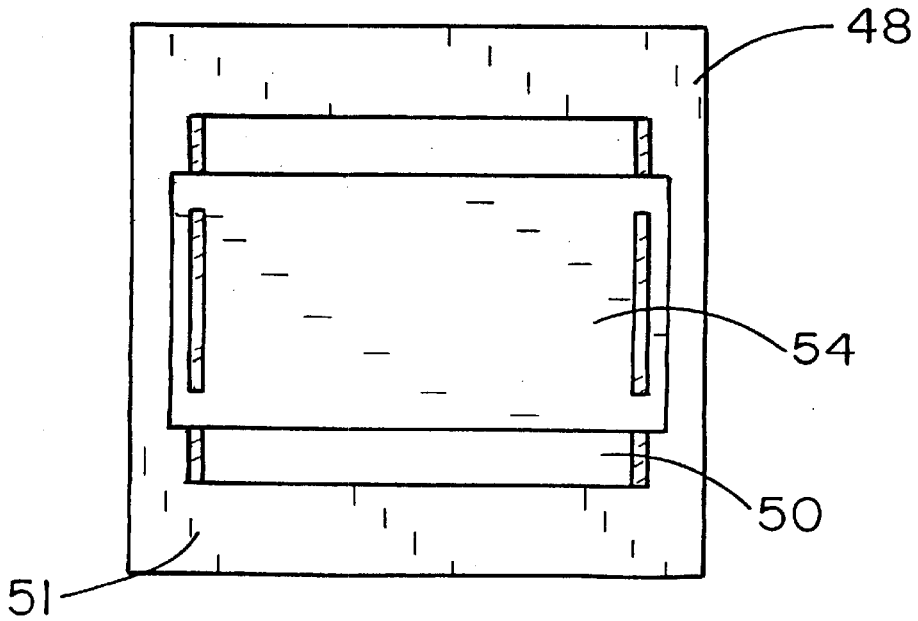
FIG. 3 is a schematic top view of the present invention showing a tabletop section and a table seat section.
Figure 4:
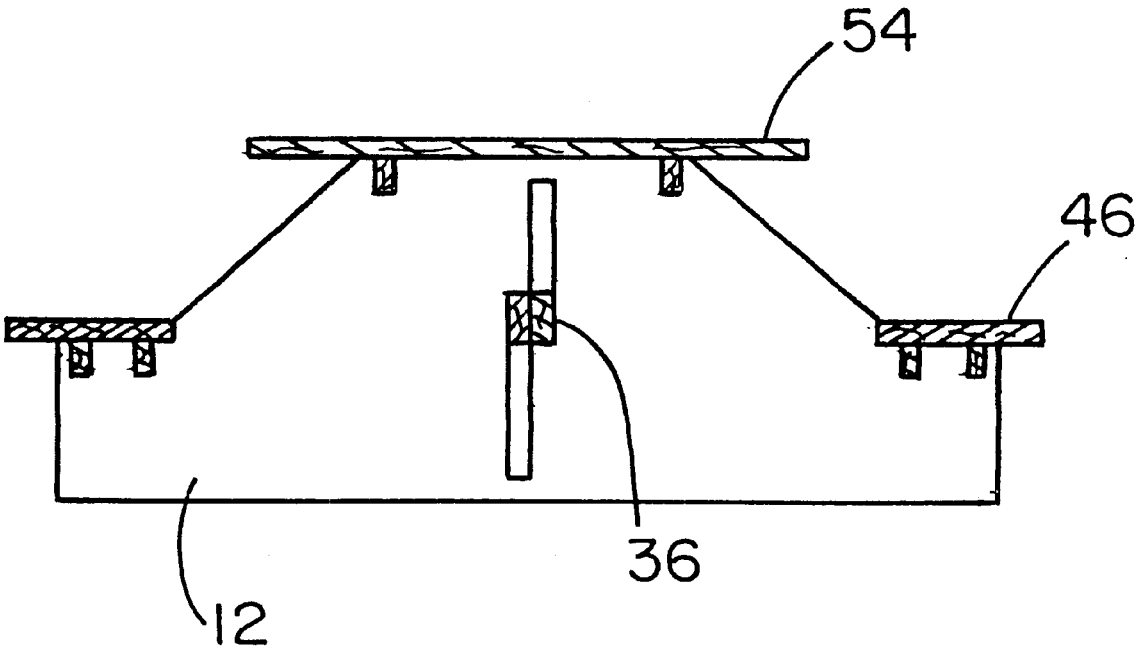
FIG. 4 is a schematic cross-sectional view of the present invention taken along line 4—4 of FIG. 2 and particularly showing the tabletop section and the table seat section resting on the support section.

With reference now to the drawings, and in particular to FIGS. 1 through 5 thereof, a new collapsible table assembly embodying the principles and concepts of the present invention and generally designated by the reference numeral 10 will be described.

As best illustrated in FIGS. 1 through 5, the collapsible table assembly 10 generally comprises a pair of table end panels 12. Each of the table end panels 12 comprises a top portion 14 and a bottom portion 15 coupled together. In one embodiment, the bottom portion 15 has a generally rectangular shape that includes a first end 16, a second end 17, a top edge 18 and a bottom edge 19. The bottom portion 15 also includes an aperture 20 extending therethrough. The aperture 20 is positioned generally between the first and second ends 16 and 17 of the bottom portion 15 and is positioned generally adjacent to the bottom edge 19. The top edge 18 of the bottom portion 15 includes a plurality of channels 22 extending therein. A first pair 23 of channels 22 is positioned generally adjacent to the first end 16 of the bottom portion 15. A second pair 24 of channels 22 is positioned generally adjacent to the second end 17 of the bottom portion 15. A central section 25 extends between each pair of channels 22. In an illustrative embodiment of the invention, the bottom portion 15 may have a length measuring approximately 32 inches from first end 16 to second end 17 and a height of approximately 11½ inches. The channels may have a depth measuring approximately ½ inches and a width measuring approximately 1 inch.

In one embodiment, the top portion 14 is coupled to and extends away from the central section 25 of the top edge 18 of the bottom portion 15 such that the first and second ends 16 and 17 of the bottom portion 15 extend outwardly beyond the top portion 14.

The top portion 14 includes a top edge 28 and a pair of side edges 29. A distance between the side edges 29 of the top portion 14 generally taper from the bottom portion 15 toward the top edge 28 of the top portion 14 such that the top portion 14 has a generally trapezoidal-shape. The top edge 28 of the top portion 14 includes a pair of notches 30 extending therein. Each of the notches 30 is positioned generally adjacent to one of the side edges 29 of the top portion 14. The top portion 14 also includes a hole 32 extending therethrough. The hole 32 is positioned generally between each of the notches 30. Each of the table end panels 12 may comprise a substantially rigid material such as, for example, one-half inch or three-quarter inch plywood or a plastic material. In the illustrative embodiment, the top portion 14 may have a length measuring approximately 22½ inches at the juncture between the bottom portion 15 and the top portion 14. The top edge 18 of the top portion 14 has a length measuring approximately 14 inches. The notches 30 has a depth measuring approximately ½ inches.

Figure 5:
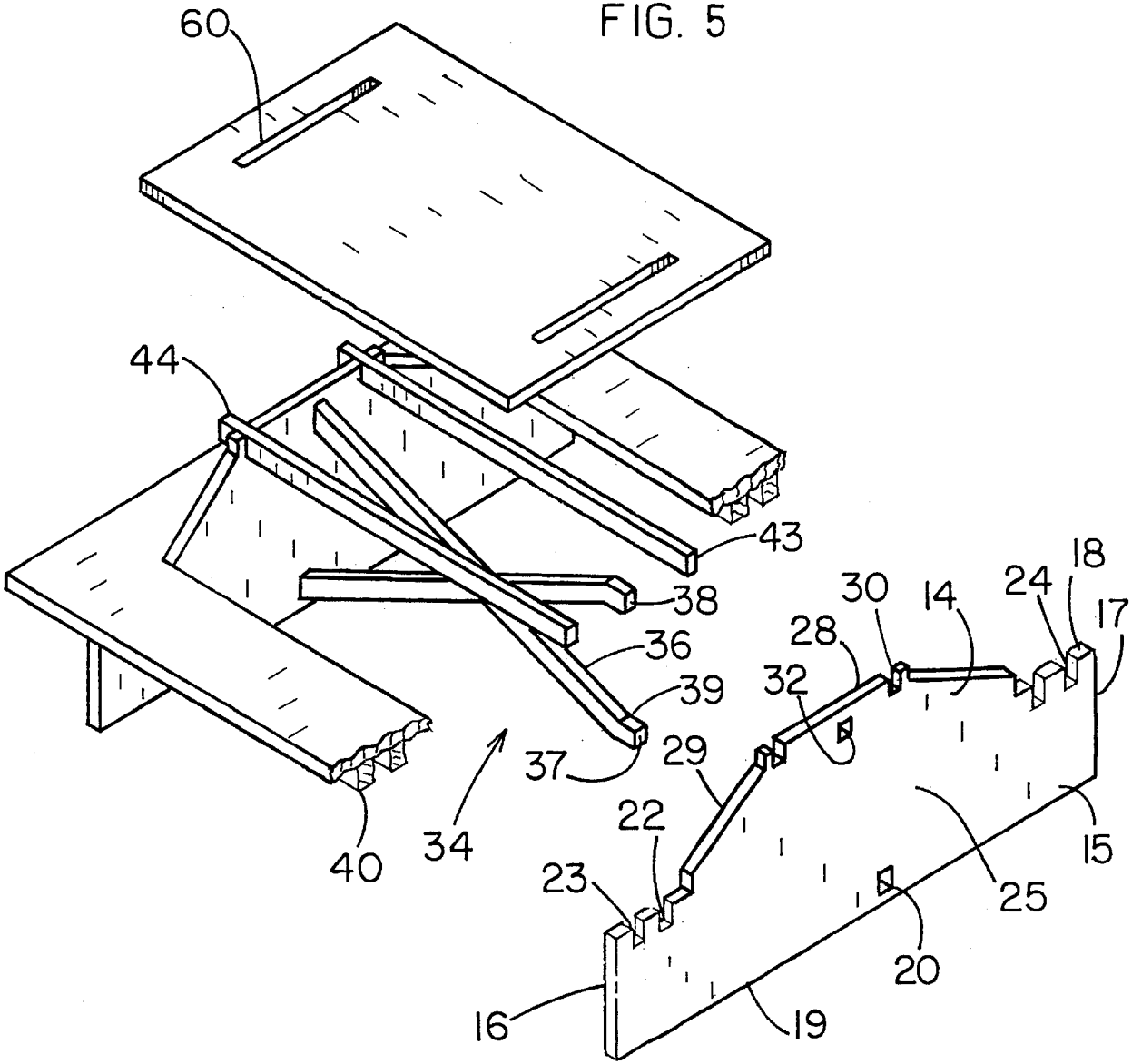
FIG. 5 is a schematic exploded view of the present invention showing the support sections and their placement in assembling the new collapsible table assembly.

As illustrated in FIG. 5, The collapsible table assembly also includes a plurality of table support sections 34 is removably couplable to each of the end table sections 12. The plurality of table support sections 34 includes at least a pair of intermediate cross-bars 36. Each of the intermediate cross-bars 36 is elongated and includes a first end 37 and a second end 38. Each of the intermediate cross-bars 34 has a pair of bends 39 therein. Each of the bends 39 is positioned generally adjacent to one of the ends 38 and 38 of the intermediate cross-bars 34. Each of the first ends 37 of the intermediate cross-bars 34 is removably extendable in one of the apertures of the bottom portions 15. Each of the second ends 38 of the intermediate cross-bars 34 is removably extendable in one of the holes 32 of the top portions 14 such that each of the intermediate cross-bars 34 extend diagonally from the top edge 28 of the top portion 14 to the bottom edge 19 of the bottom portion 15.

The support sections 34 also include a plurality of lower cross-bars 40. Each of the lower cross-bars 40 is elongated and includes a pair of ends 41. Each of the ends 41 is removably extendable in one of the channels 22 of each of the bottom portions 15. The support sections additionally include at least a pair of upper cross-bars 43. Each of the upper cross-bars 43 is elongated and includes a pair of ends 44. Each of the ends 44 is removably extendable in one of the notches 30 of each of the top portions 14. Each of the support sections 34 may comprise a substantially rigid material such as, for example, a plywood or a plastic material. In the illustrative embodiment, each of the support sections 34 has length measuring approximately 43 inches and a height measuring approximately 2 inches.

A table seat section 46 comprising a panel 47 is included in the collapsible table assembly 10. The panel 47 includes a top surface 48 and a bottom surface 49. A hole 50 extends through the seat section 46 defining a pair of seat portions 51 coupled together. The hole 50 of the table seat section 46 includes a size and shape designed for removably receiving the top portion 14 of the end panels 12 therethrough. The bottom surfaces 49 of the seat portions 51 selectively rest on the top edge 18 of the bottom portion 15 of the end panels 12. The bottom surface 49 also rests on the lower cross-bar sections 40. The table seat section 46 has a generally rectangular shape. However, the table seat section 46 may optionally have a variety of shapes such as, for example, a circular or diamond shape. In the illustrative embodiment, the seat portions 51 have a length measuring approximately 43 inches long and a width measuring approximately 8 inches.

The collapsible table assembly 10 also includes a tabletop section 54. The tabletop section 54 comprises a panel 56 that includes a pair of ends 58. The tabletop section 54 also includes a pair of elongated slots 60 extending therethrough for receiving a portion of the end panels 12. The top edge 28 of each of the top portions 14 includes a size designed for being removably insertable in one of the elongated slots 60. The tabletop section 54 may comprise a generally rectangular shape. However, the tabletop section 54 may also comprise a variety of other shapes such as, for example, a circular or diamond shape. In the illustrative embodiment, the tabletop section 54 has a length measuring approximately 37 inches between the pair of ends 58 and a width measuring approximately 19 inches.

In use, the collapsible table assembly 10 is disassembled during transportation and storage. When the collapsible table assembly 10 is needed, the intermediate cross-bars 36 are extended into the aperture 20 and hole 32 of the table end portions 12. The lower and upper cross-bars 40 and 43 are then inserted into the notches and channels 22 and 30 of the top and bottom portions 14 and 15 of the table end panels 12. The table seat section 46 is then placed on the lower cross-bars 40 with the top portions 14 of the table end portions 12 extending through the hole 50 in the table seat section. The tabletop section 54 is placed on the top portion 14 of each of the table end panels 12 with the top edge 28 of the top portion 14 extending through the elongated slots 60 of the tabletop section 54. It will be noted that forming the parts of the table using the dimensions of the illustrative embodiment permits the parts to be constructed from a single 4-foot by 8-foot sheet of plywood.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible table assembly comprising:

a pair of table end panels, each of said table end panels comprising a top portion and a bottom portion for resting on a ground surface, said top portion of each of said table end panels having a top edge;

a pair of upper cross-bars each having a pair of ends removably couplable to each of said table end panels adjacent to said top edge of said top portions of said table end sections;

a table seat panel having a hole extending therethrough, wherein said hole removably receives said top portions of said table end panels therethrough so that said table seat panel rests on said bottom portions of said table end panels and supports said table seat panel in an elevated condition above the ground surface; and a tabletop panel having a pair of ends, said tabletop panel having a pair of elongated slots extending therethrough for each removably receiving a portion of said top portions of said table end panels.

2. The collapsible table assembly of claim 1, additionally comprising a pair of intermediate cross bars each having opposite ends, wherein said bottom portion of each of said table end panels has an aperture extending therethrough, each of said apertures being positioned generally between a first end and a second end of said bottom portion and being positioned generally adjacent to a bottom edge, said top portion of each of said table end panels having a hole extending therethrough, each of said holes being positioned generally adjacent to said top edge of said top portion, wherein a first said end of said pair of intermediate cross-bars is removably insertable in said aperture and a second said end of said pair of intermediate cross-bars is removably insertable into one of said holes.

3. The collapsible table assembly of claim 2, wherein each of said pair of intermediate cross-bars has a pair of bends therein, each of said bends being positioned generally adjacent to one of said ends of each of said intermediate cross-bars.

4. The collapsible table assembly of claim 1, additionally comprising a plurality of lower cross bars having opposite ends, wherein a top edge of said bottom portion of each of said table end portions has a plurality of channels extending therein, a first pair of channels being positioned generally adjacent to a first end of said bottom portion and a second pair of channels being positioned generally adjacent to a second end of said bottom portion, wherein each of said ends of said plurality of lower cross-bars being removably positioned in one of said channels.

5. The collapsible table assembly of claim 1, wherein said top edge of said top portion of each of said table end portions has a pair of notches extending therein, each of said notches being positioned generally adjacent to one of a pair of side edges of said top portion, wherein each of said ends of said pair of upper cross-bars being removably positionable in one of said notches.

6. The collapsible table assembly of claim 1, wherein a top edge of each of said top portions of said table end panels having a size adapted for being removably insertable in one of said elongated slots.

7. A collapsible table assembly comprising:

a pair of table end panels, each of said table end panels comprising a top portion and a bottom portion for resting on a ground surface, said top portion of each of said table end panels having a top edge;

a pair of upper cross-bars each having a pair of ends removably couplable to each of said table end panels adjacent to said top edge of said top portions of said table end sections;

a table seat panel having a hole extending therethrough, wherein said hole removably receives said top portions of said table end panels therethrough so that said table seat panel rests on said bottom portions of said table end panels and supports said table seat panel in an elevated condition above the ground surface; and a tabletop panel having a pair of ends, said tabletop panel having a pair of elongated slots extending therethrough for each removably receiving a portion of said top portions of said table end panels;

a pair of intermediate cross bars each having opposite ends, wherein said bottom portion of each of said table end panels has an aperture extending therethrough, each of said apertures being positioned generally between a first end and a second end of said bottom portion and being positioned generally adjacent to a bottom edge, said top portion of each of said table end panels having a hole extending therethrough, each of said holes being positioned generally adjacent to said top edge of said top portion, wherein a first said end of said pair of intermediate cross-bars is removably insertable in said aperture and a second said end of said pair of intermediate cross-bars is removably insertable into one of said holes;

wherein each of said pair of intermediate cross-bars has a pair of bends therein, each of said bends being positioned generally adjacent to one of said ends of each of said intermediate cross-bars;

a plurality of lower cross bars having opposite ends, wherein a top edge of said bottom portion of each of said table end portions has a plurality of channels extending therein, a first pair of channels being positioned generally adjacent to a first end of said bottom portion and a second pair of channels being positioned generally adjacent to a second end of said bottom portion, wherein each of said ends of said plurality of lower cross-bars being removably positioned in one of said channels;

wherein said top edge of said top portion of each of said table end portions has a pair of notches extending therein, each of said notches being positioned generally adjacent to one of a pair of side edges of said top portion, wherein each of said ends of said pair of upper cross-bars being removably positionable in one of said notches;

wherein a top edge of each of said top portions of said table end panels having a size adapted for being removably insertable in one of said elongated slots.

* * * * *